United States Patent [19]

Giercarz et al.

[11] Patent Number: 4,837,874

[45] Date of Patent: Jun. 13, 1989

[54] PERSON LIFTING DEVICE

[76] Inventors: Mieczyslaw Giercarz, 11 Rue de Barly, 62810 A-le-Comte, France; Jaroslaw G. Alfer, 1331 Lilac Ter., Los Angeles, Calif. 90026

[21] Appl. No.: 85,736

[22] Filed: Aug. 17, 1987

Related U.S. Application Data

[63] Continuation-in-part of Ser. No. 933,172, Nov. 21, 1986, abandoned.

[51] Int. Cl.[4] ..... A61G 7/10

[52] U.S. Cl. ..... 5/83; 5/86

[58] Field of Search ..... 5/81 R, 83–87, 5/89

[56] References Cited

U.S. PATENT DOCUMENTS

| | | | |
|---|---|---|---|
| 812,358 | 2/1906 | Oliver . | |
| 832,517 | 10/1906 | Wilt . | |
| 977,243 | 11/1910 | White . | |
| 1,620,298 | 3/1927 | Smith . | |
| 2,125,546 | 8/1938 | Corr . | |
| 2,498,853 | 2/1950 | Hassold et al. . | |
| 2,739,783 | 3/1956 | Pentecost | 5/86 X |
| 2,792,945 | 5/1957 | Brenny . | |
| 2,903,238 | 9/1959 | Flandrick | 5/86 X |
| 2,962,730 | 12/1960 | Carnes et al. . | |
| 2,975,434 | 3/1961 | Butler et al. | 5/86 |
| 3,131,404 | 5/1964 | Bower et al. . | |
| 3,469,269 | 9/1969 | Brown . | |
| 4,195,375 | 4/1980 | Korchinski . | |
| 4,420,052 | 12/1983 | Hale . | |

FOREIGN PATENT DOCUMENTS

| | | | |
|---|---|---|---|
| 145459 | 8/1902 | Fed. Rep. of Germany . | |
| 775907 | 10/1934 | France | 5/89 |
| 1062063 | 4/1954 | France | 5/87 |
| 1318012 | 1/1962 | France . | |
| 2533436 | 3/1984 | France . | |

*Primary Examiner*—Gary L. Smith
*Assistant Examiner*—Michael F. Trettel
*Attorney, Agent, or Firm*—William H. Maxwell

[57] ABSTRACT

A beam contained in a horizontal plane and suspended by a frame equipped with a lift and column on a vertical axis, with rotation of the beam in said horizontal plane, and equipped with at least one C-shaped body handling tong and preferably a plurality thereof and each adapted to pass beneath and at least partially under a person's body to lift the same, and characterized by instantly adjustable and immediately removable vertical height positioning means for suspending the body handling tongs.

9 Claims, 3 Drawing Sheets

FIG. 1.
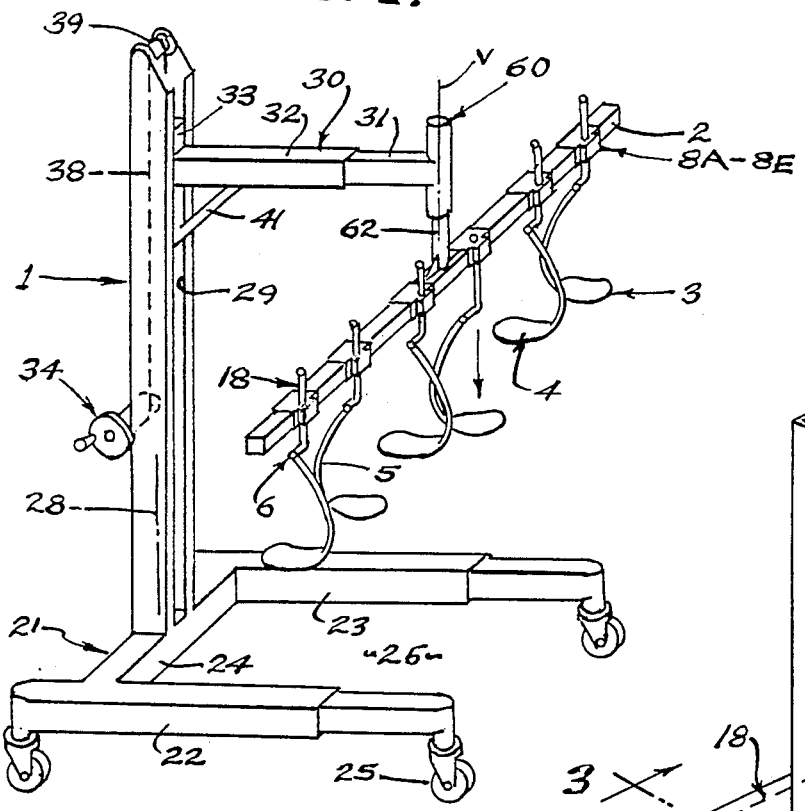
FIG. 2.
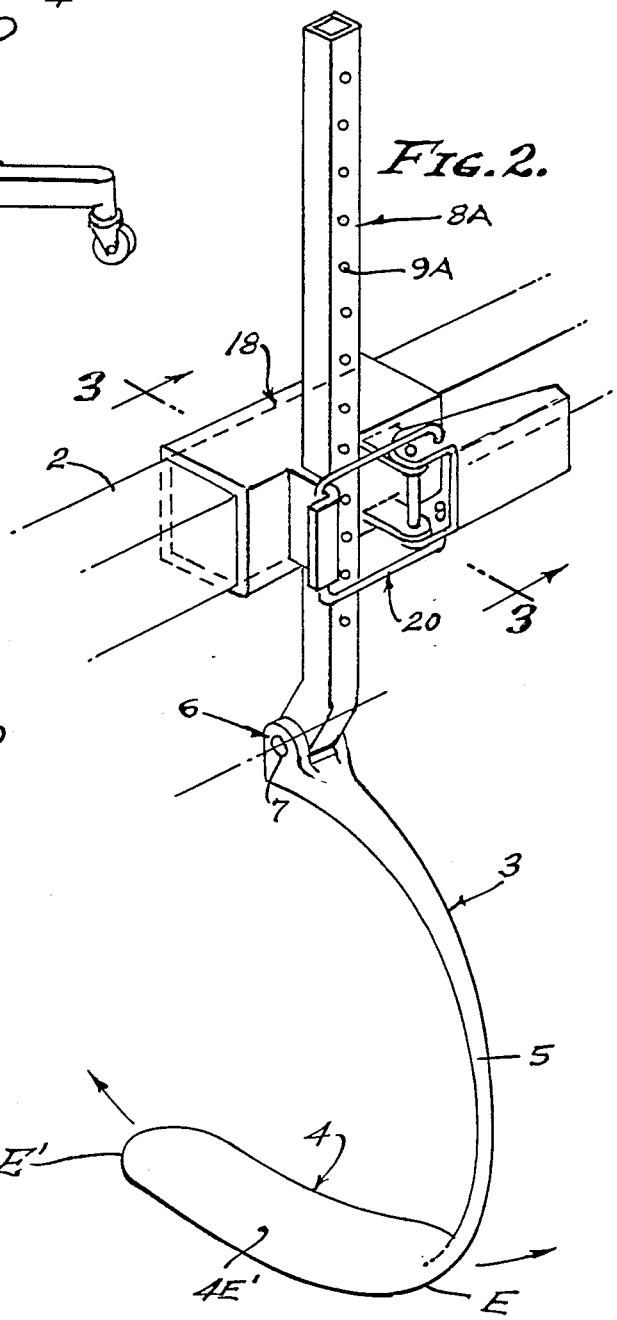
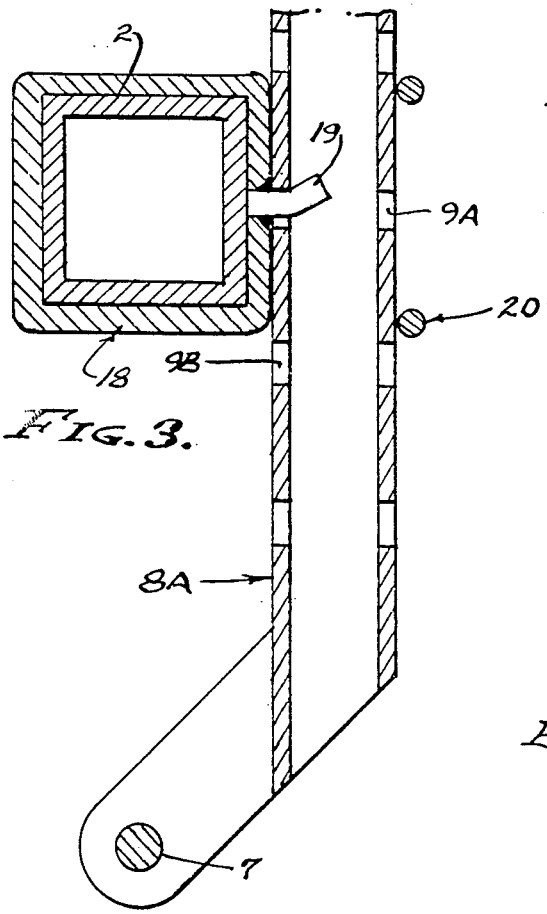
FIG. 3.

PERSON LIFTING DEVICE

This application is a Continuation in Part of application Ser. No. 933,172 filed Nov. 21, 1986 now abandoned which claims priority benifits under Title 35, United States Code, Par. 119, as set forth in the Declaration filed therewith.

BACKGROUND OF THE INVENTION

The object of this invention is to provide a person lifting device capable of lifting persons generally sick, handicaped or injured, whether lying on a bed or on the ground. Such a device is disclosed in U.S. Pat. No. 4,195,475, to lift a person lying on a bed; having a base topped by a cross-beam equiped with two beams some distance apart that can be positioned above and parallel to the person, and having flexible straps fastened at one end to one of the beams at set intervals that are placed under the person and hang from the other beam so as to support the person. The collocation of such flexible straps, especially their placement underneath the person's body, is delicate and difficult, and generally requires the mediation of two helpers, one introducing the flexible straps on one side of the person's body, and the other retrieving the flexible straps on the other side of the person's body in order to hang them on the beam. In addition, such a device is not suited to lift a person lying on a bed which cannot be accessed on one of its sides.

The primary object of this invention is to provide a person lifting device that can be implemented simply and speedily.

Another object of this invention is to provide such a device that is secure, and that will avoid more particularly that the person be subjected to any swaying during the transportation.

It is still another object of this invention to provide a device that will facilitate lifting a person not easily accessible when lying in a bed or lying on the ground.

More specifically, it is an object of this invention to provide instantly adjustable and immediately replaceable vertical height positioning means for the suspended support of the body handling tongs. In a first embodiment, the vertical height positioning means is incrementally and reversably adjustable on a hook and the body handling tongs are swiveled therefrom to swing beneath a person. In a second embodiment, the vertical height positioning means is incrementally adjustable on a ratchet or rack and the body handling tongs are omni positionable to swing therefrom. In a third embodiment, the vertical height positioning means is infinitely adjustable by a jam cleat and flexible for limited swinging movement to engage the tongs beneath a person. In a fourth embodiment, the vertical height positioning means is infinitely adjustable by a jam cleat and flexible rope or cord for omni movement and placement of the tongs beneath a person. And in the fifth embodiment, the vertical height positioning means is infinitely adjustable and omni positionable by a strap and buckle means that permits complete freedom, twisting and turning.

SUMMARY OF THE INVENTION

This person lifting device comprises:

a frame;

a beam hanging from the frame, contained in a plane horizontal to a given level and intended to be place above and parallel to a person lying in a plane substantially parallel to the horizontal plane;

at least one lifting implement or means attached to the beam and suited to pass at least partially under the said person; and a hoisting means incorporated on the frame and moving the lifting means along a vertical axis perpendicular to the horizontal plane.

According to the invention the lifting implement or means consists of at least one C-shaped body handling tong. Preferably, the lifting implement or means is a C-shaped body handling tong with a head fitted with a connecting member which is set into a releasable regulating mechanism A device in conformity with this invention has a frame in which are incorporated lifting means hoisting the beam along a vertical axis perpendicular to the horizontal plane contained with and passing along the beam; it also includes;

U-shaped base-platform contained in a substantially horizontal plane, preferably comprised of two parallel side stringers, set at a distance at least equal to a person's width, and united together by a cross-piece marking out a free area bounded by the side stringers, the vertical traveling axis of the beam moving at least along the free area;

column raised on the base-platform, fitted with an arm supporting the beam in the horizontal plane; and the arm including a rotation device allowing the beam to rotate in the horizontal plane.

The foregoing and various other objects and features of this invention will be apparent and fully understood from the following detailed description of the typically preferred forms and applications thereof, throughout which description reference is made to the accomanying drawings:

THE DRAWINGS

FIG. 1 is a general view in perspective of a device in conformity with this invention.

FIG. 2 is a view in perspective and showing a first embodiment of this invention with a C-shaped body handling tong joined to a beam by a vertically adjustable member with safety means.

FIG. 3 is an enlarged sectional view taken as indicated by line 3—3 on FIG. 2, showing the reversible and vertical adjustment of the body handling tong.

Figure 9:
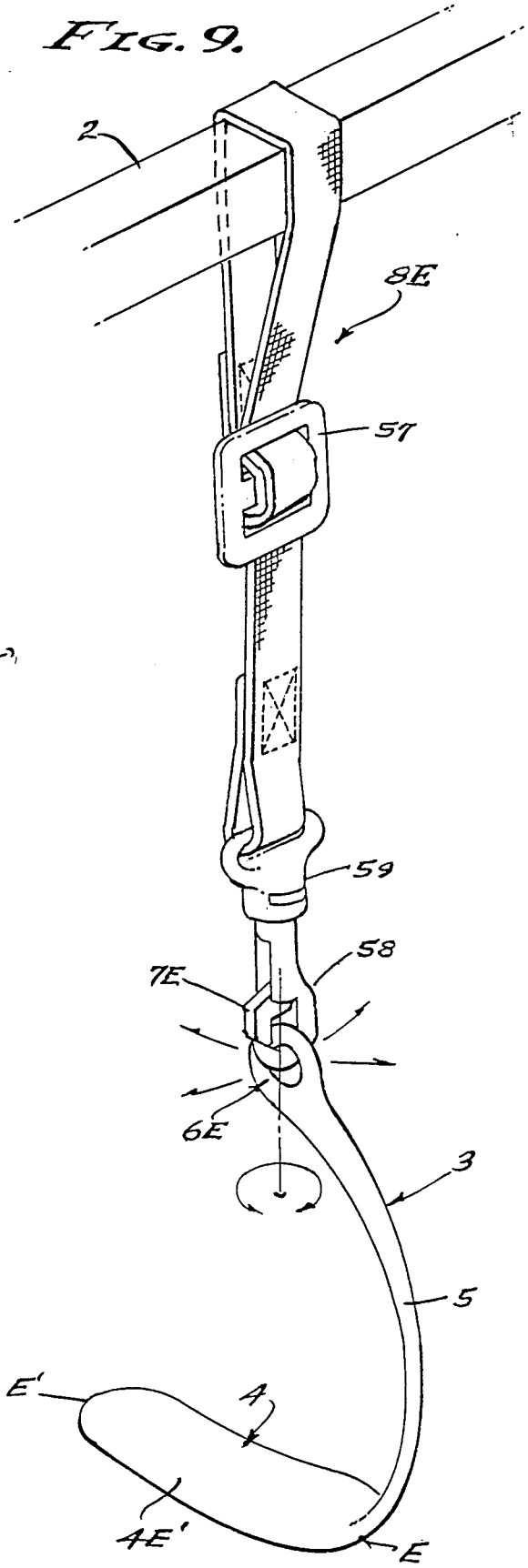

And, FIG. 9 is a perspective view of a fifth embodiment of this invention, showing a C-shaped body handling a tong joined to a beam by a vertically adjustable and flexible strap member and safety buckle, and infinitely positioned.

PREFERRED EMBODIMENT

The person lifting device described as an example and according to FIG. 1 includes a frame[1] carrying a beam 2 fairly contained in a horizontal plane H and fitted with one or more movable body lifting means adapted to go at least in part under a person's body to lift it upward. Each body lifting means is a body lifting tong 3, as shown throughout the drawings. Each body handling tong 3 is made of a support part such as a rigid curved blade 4 with a small thickness, extended by a rigid bent element 5 (C-shaped), and completed by a head 6 provided with a vertical height position regulating means (8A–8E).

Naturally, the configuration of the tong 3 is directly determined by the morphology of the person to be lifted. In this way the blade length as defined between end E and the end E′ must be fairly equal or preferably superior to the width of the part of the body in contact with the blade; for example, a body handling tong 3 placed under the legs has a smaller blade than the one under a person's back. Moreover, the blade is slightly curved in its main part 4E so as to correspond exactly ito the shape of the person's body and has a width commensurate with the part of the body in contact with the blade. In addition, this main part 4E, towards its extremity E′ and until this extremity E′, ends with an untmost part 4E′ presenting a greater curve than that of the main part to as to avoid and slipping motion of the person.

Firstly, a U-shaped base-platform is made up of two side stringers 22 and 23, preferably of the telescopic type, set apart, parallel and joined by a cross-member 24; a free area thus being established between the side stringers 22 and 23 defined by the cross member 24. This base-platform 21 has rolling means 25 so as to enable it to move easily on a ground 26, such as for instance casters placed at each of the side stringers 22 and 23. The base-platform defines a plane substantially parallel on the one hand to the ground 26 and which the person lifting device must move when it is being used, and on the other hand to the plane containing the beam 2; these two planes will henceforth be called horizontal planes.

Secondly, a column 27 with a longitudinal axis perpendicular to the horizontal plane, that will henceforth be called the vertical axis, is raised on base platform 21, preferably on the center of the cross-member 24. This column 27 is made for example of a hollow tube with a rectangular section which has a slot 29 extending along the longitudinal axis over the entire length thereof.

Thirdly, an arm 30 of the telescopic type, has a front element 31 and a back element 32 over the front element 31. The latter sustains beam 2, and the back element 32 extends through a slot 29 and is attached to a guiding device 3 sliding vertically inside the column.

The vertical translation movement of the guiding device 33 is obtained through a hoisting means 34 placed on the column at an accessible level, to which is attached the end of a strap 38 that can be wound thereon. This strap goes over a pulley 39 located at the upper end of the column 27, and its terminal end is attached to the guiding device or carriage 33, and on this carriage is carried the rear element 32 of the telescopic arm 30 with a brace 41 to the rear element 32. The front element 31 of arm 30 is equipped with a rotation means 60 for beam 2 in the horizontal plane. The front element 31 has a sleeve 61 for the vertical axis V of rotation, in which is assembled a revolving shaft 62 from which the beam 2 is suspended horizontally for rotation in the horizontal plane.

Figure 4:
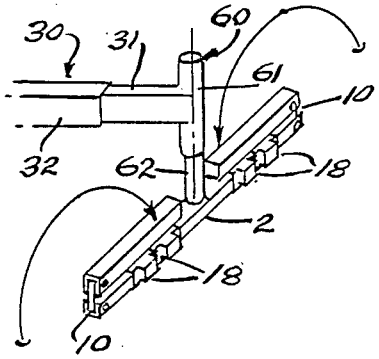
FIG. 4 is an enlarged fragmentary view of a portion of FIG. 1, showing collapse of the beam with the body handling tongs removed.

The person lifting device equipped with its vertical height position regulating means is characterized by a collapsible beam 2 disposed in a horizontal position, with horizontal position regulating means 18 which travel by translation coextensively along the beam 2 without rotation; for example, the horizontal position regulating means 18 has a straight square section slightly superior to the straight section of beam 2 which is also square. The horizontal position regulating means 18 is essentially a carriage that receives and carries the vertical height position regulating means shown herein in five embodiments in FIGS. 2, 5, 7, 8 and 9. As shown, in FIG. 4 the beam 2 is collapsed by folding opposite end sections thereof upwardly by means of offsetting toggle type hinges 10, whereby the folded sections are spaced apart from the center section thereof so as to accomodate the slideable carriages of the means 18. The carriages of the horizontal position regulating means 18 are removable as indicated.

The vertical height position regulating means 8A of the first embodiment shown in FIGS. 2 and 3 involves a vertically disposed bar, preferably a rigid tubular member, and carrying a connecting pin 7 at its lower end, and provided with a series of spaced holes 9A and 9B at the front and back of the tube member thereof, and with the axes thereof substantially parallel to the rigid blade 4 of the underlying tong 3. In this first embodiment, the horizontal position regulating means 18 is fitted with an anchoring fixture 19 (FIG. 3) in the form of a hook-shaped lug suitable to be introduced or inserted through any one of the series of holes 9A or 9B at the front or back of the vertically disposed regulating means 8A. Preferably, the horizontally disposed regulating means 18 is also provided with a locking means 20 such as a securety toggle means releasably anchoring the body lifting means to the beam 2. Accordingly, the body handling tong 3 is instantly adjustable and/or removable, and seeks a comfortable position with respect to the person to be lifted.

Figure 6:
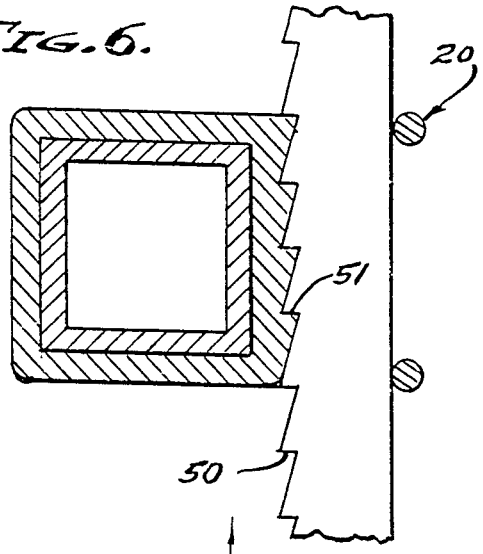
FIG. 6 is an enlarged sectional view taken as indicated by line 6—6 on FIG. 5, showing the adjustable engagement of the ratchet member.
Figure 6:
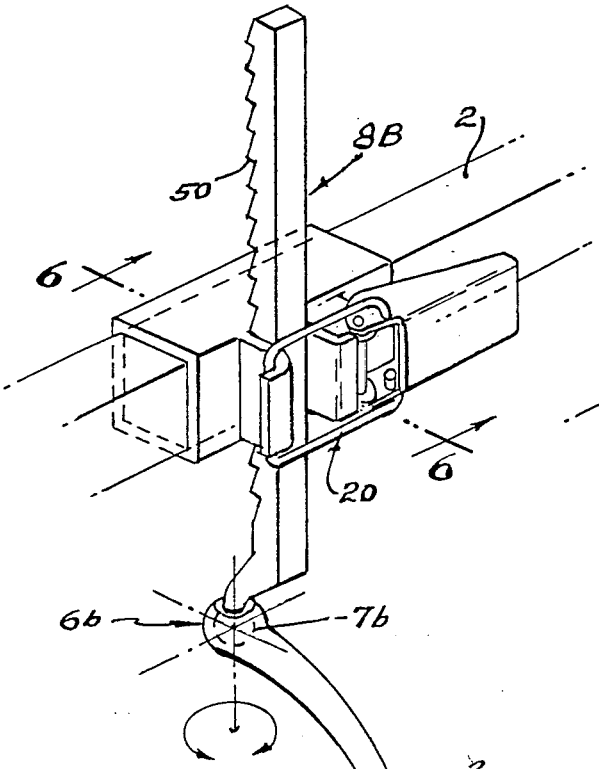
Figure 5:
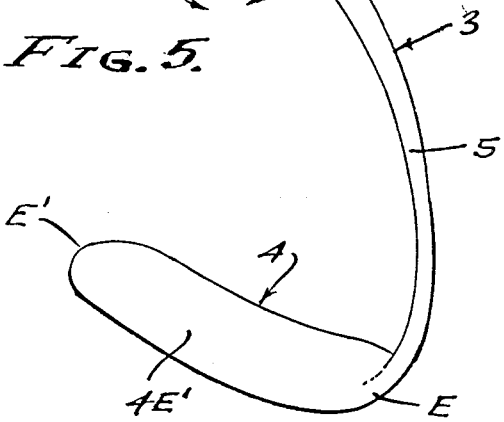
FIG. 5 is a perspective view of a second embodiment of this invention, showing a C-shaped body handing a tong joined to a beam by a vertically adjustable ratchet member with safety means.
Figure 5:
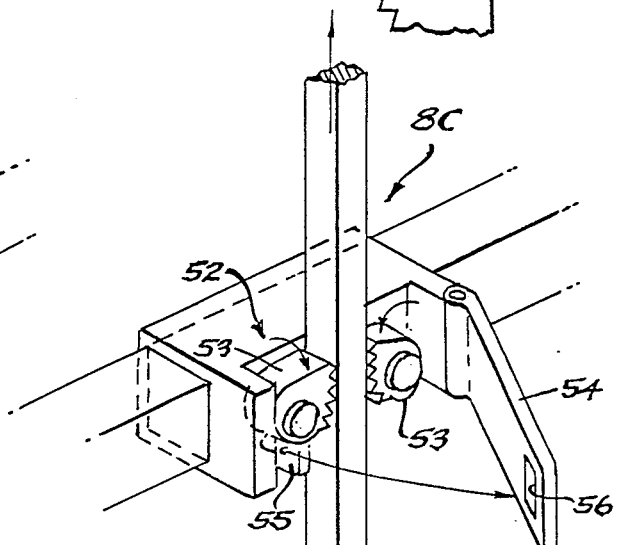

The vertical height position regulator means 8B of the second embodiment shown in FIGS. 5 and 6 involves a vertically disposed ratchet or rack bar, preferably a solid member, and carrying a connecting ball **7*b* at its lower end, and provided with a vertical series of spaced downwardly faced teeth 50 at the back thereof. In this second embodiment, the horizontal position regulating means 18 is fitted with spaced upwardly faced teeth 51 complementary to the teeth 50 to be engaged thereby as shown. The locking means 20 is the same as above described, and closes onto the front side of the ratchet or rack bar so as to releasably secure it by means of its toggle action. A feature of this second embodiment is its socket head 6*b* is affixed onto the ball 7*b* so as to turn and swing in omni directions as is indicated. Accordingly, the body tong 3 is instantly adjustable and/or removable from the desired vertical position with respect to beam 2**, and is omni positionable with respect to the person to be lifted.

Figure 7:
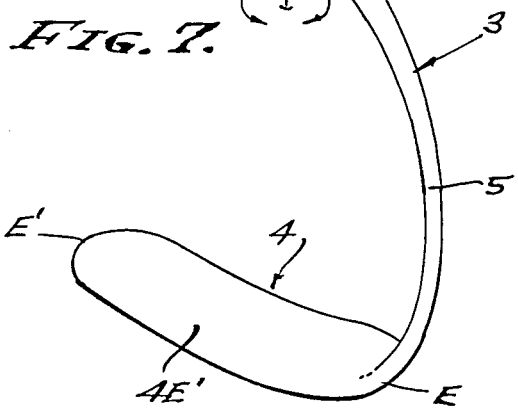
FIG. 7 is a perspective view of a third embodiment of this invention, showing a C-shaped body handling tong joined to a beam by a vertically adjustable flexible rod member received by an infinitely positioning jam cleat with safety means.

The vertical height position regulator means 8C of the third embodiment shown in FIG. 7 involves a vertically disposed flexible rod or bar member, preferably of solid plastic material such as Nylon or Teflon or any other suitable polymer or the like, which is also depressible and subject to being firmly gripped by the teeth of spaced eccentric members 53 of a jam-cleat 52. The toothed members 53 are inwardly biased by spring means (not shown) in the usual manner and as shown by the arrows in FIG. 7. The rod or bar member can be set infinitely as to height and with respect to the beam 2, and safety securement is by means of a hasp 54 held by a turning key 55 that enters through an opening 56 through the end portion of the hasp. A feature of this third embodiment is its inherent flexibility that permits swinging and twisting motions as indicated. Accordingly, the body handling tong 3 is instantly adjustable and/or removable from its desired vertical position with respect to beam 2, and seeks a comfortable position with respect to the person to be lifted.

Figure 8:
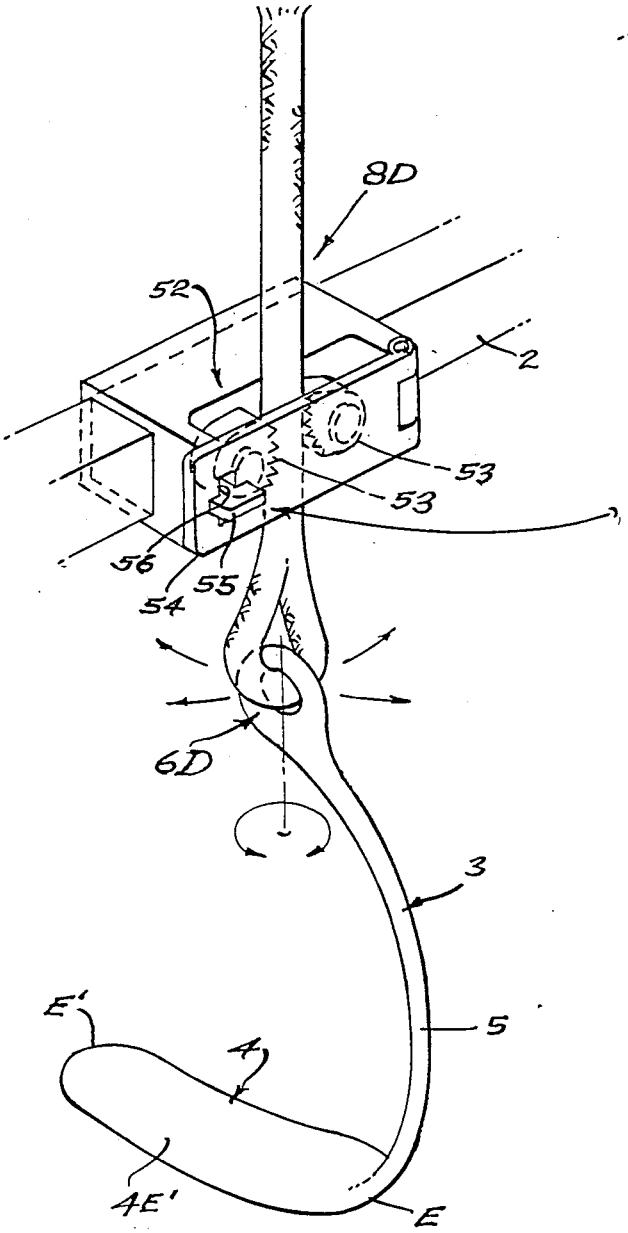
FIG. 8 is a perspective view of a fourth embodiment of this invention, showing a C-shaped body handling tongs joined to a beam by a vertically adjustable flexible rope member received by an infinitely positioning jam-cleat with safety means.

The vertical height position regulator means 8D of the fourth embodiment shown in FIG. 8 involves a vertically disposed flexible rope or cord member, preferably a braided sheath multifiliment Nylon line or the like which is depressible and subject to being firmly gripped by the teeth of spaced eccentric members 53 of the jam cleat 52, the same as hereinabove described. The toothed members 53 are inwardly biased by spring means (not shown) in the usual manner and as shown by the arrows in FIG. 8. The rope or cord can be set infinitely as to height and with respect to the beam 2, and safety securement is by means of a hasp 54 held by a turning key 55 that enters through an opening 56 through the end portion of the hasp, as above described. A feature of this fourth embodiment is its inherent flexibility that permits complete freedom, swinging and twisting motions as is indicated.

The vertical height positioning regulator means 8E of the fifth embodiment shown in FIG. 9 involves a vertically disposed flexible strap member and preferably a woven strap or the like that is flexible and adapted to be trained over the beam 2 and through a buckle 57 and a snap hook 58. The snap hook 58 is connected to the head 6E of the tong 3, in the form of an eye as it also is in the fourth embodiment. The lower terminal end portion of the flexible strap is looped around a swivel 59 and is permanently sewn together after it passes through a shackle, and turning free from the swivel and releasably carrying the head 6E under control of a latch 7E. The free live end of the strap is passed through the buckle 57 and over the beam 2, and then again through the buckle where it is permanently secured in the usual manner and as shown in FIG. 9. The adjustment is infinite and is safety secured by the buckle. A feature of this fourth embodiment is its inherent flexibility that permits complete freedom, swinging and twisting motions as is indicated.

The device in conformity with the invention as described hereinabove is used in the following way: When one wants to lift or to transport a person lying on a bed, for example, the blade 4 of the body handling tong, or tongs, 3 is introduced between the bed and the person by pressing on the bed therewtih; since the rigid blade rests against the bed having substantial flexibility, it slightly sinks into it and thus goes under the person's body without any discomfort for that person. It is preferable to give a reduced thickness to the blade to facilitate its passage under the person's body. Several C-shaped body handling tongs are passed in this way, six for example, under the person at appropriate spaces apart. It will be noted that to ensure a safe lifting of the person without any risk of slipping, especially in case of restlessness, the lifting devices made of only one C-shaped body handling tong can be placed alternately and successively on either side of the person.

After the C-shaped body handling tongs are in place, beam 2 is brought forward above the person at the level of the vertical height position regulating means 8A–8B with the help of the hoisting means 34. A horizontal position regulating means 18 is made to correspond with each vertical height position regulating means, and the latter are adjusted thereto and then made secure by the locking means 20. Finally, the person is lifted up with the hoisting means 34 and can thus be transported with the help of the mobile frame 1.

The device also allows a person lying on the ground to be lifted up with the structure occupying a reduced amount of space. For such a purpose the distance between the stringers 22 and 23 of the base-platform 21 must be included at least within a person's height and weight. Preferably for questions of space encumberment, the distance between stringers is fairly greater than the person's body width, so that the stringers come to their position on either side of the person. In order to place beam 2 in a parallel direction above the person with the help of rotation means 60, the telescopic arm 30 is extended as well as the telescopic side stringers 22 and 23, so that the course of the vertical axis V over the plane of the base-platform is always within the free area 26 to ensure the stability of the device. Also, the beam 2 of the device can be collapsed to reduce its space requirement, and when a person is lifted in a sitting posture.

Having described only the typical preferred forms and applications of our invention, we do not wish to be limited or restricted to the specific details herein set forth, but wish to reserve to ourselves any modifications or variations that may appear to those skilled in the art as set forth within the limits of the following claims.

We claim:

1. A person lifting device including;

a beam restrained in a horizontal plane in relation to a given level and to be placed above and parallel to a person lying in a plane substantially parallel to the horizontal plane, a plurality of removable vertical height position regulating means carried from the beam, and each comprised of a vertically disposed flexible member with opposite depressible sides engageable between a jam-cleat carried from the beam, a lifting means attached to the beam by each vertical height position regulating means and comprised of a body handling tong swinging from the beam and adapted to go at least partially under the said person, the body handling tong being connected to a lower end of the member to swing and twist therefrom when the member is deflected, a locking means releasably securing each removable vertical height position regulating means to the beam, and a hoisting means incorporated with a frame and adapted to move the lifting means along a vertical axis perpendicular to the horizontal plane.

2. The person lifting device according to claim 1, wherein the vertical height position regulating means is comprised of a vertically disposed flexible bar member with opposite depressible sides engageable between the jam-cleat, the body handling tong being connected to a lower end of the bar member.

3. The person lifting device according to claim 1, wherein the jam-cleat is comprised of a pair of toothed eccentrics spring biased to close upon the member releasably inserted therein.

4. The person lifting device according to claim 1, wherein the locking means is a hasp secured by a turning key disengageable through a hole therethrough.

5. A person lifting device including;

a beam restrained in a horizontal plane in relation to a given level and to be placed above and parallel to a person lying in a plane substantially parallel to the horizontal plane, a plurality of removable vertical height position regulating means carried from the beam, and each comprised of a vertically disposed flexible rope member with opposite depressible sides engageable between a jam-cleat carried from the beam, a lifting means attached to the beam by each vertical height position regulating means and comprised of a body handling tong swinging from the beam and adapted to go at least partially under said person, the body handling tong being connected by means to swing free from a lower end of the rope member, a locking means releasably securing each removable vertical height position regulating means to the beam, and a hoisting means incorporated with a frame and adapted to move the lifting means along a vertical axis perpendicular to the horizontal plane.

6. The person lifting device according to claim 5, wherein the locking means is a hasp secured by a turning key disengageable through a hole therethrough.

7. A person lifting device including;

a beam restrained in a horizontal plane in relation to a given level and to be placed above and parallel to a person lying in a plane substantially parallel to the horizontal plane, a plurality of removable vertical height position regulating means carried from the beam, and each comprised of a vertically disposed rigid rack member with a series of vertically spaced teeth selectively received by at least one tooth projecting from the beam, a lifting means attached to the beam by each vertical height position regulating means and comprised of a body handling tong swinging from the beam and adapted to go at least partially under the said person, the body handling tong being connected by means to swing from a lower end of the rack member, a locking means releasably securing each removable vertical height position regulating means to the beam, and a hoisting means incorporated with a frame and adapted to move the lifting means along a vertical axis perpendicular to the horizontal plane.

8. The person lifting device according to claim 7, wherein the means connecting the body handling tong to the lower end of the rack member is a ball and socket.

9. The person lifting device according to claim 7, wherein the locking means is a releasable toggle means.

* * * * *